US007270549B2

(12) United States Patent
Ju et al.

(10) Patent No.: US 7,270,549 B2
(45) **Date of Patent: *Sep. 18, 2007**

(54) ELECTRICAL CONNECTOR

(75) Inventors: Ted Ju, Keelung (TW); Wen-Chung Chang, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/333,411

(22) Filed: Jan. 18, 2006

(65) Prior Publication Data

US 2007/0077804 A1 Apr. 5, 2007

(30) Foreign Application Priority Data

Sep. 30, 2005 (CN) ..... 2005 2 0065282

(51) Int. Cl.
*H01R 12/00* (2006.01)

(52) U.S. Cl. ..... 439/66; 439/342

(58) Field of Classification Search ..... 439/66, 439/259–268, 330–331, 342
See application file for complete search history.

(56) References Cited

U.S. PATENT DOCUMENTS 7,125,274 B1 * 10/2006 Ju et al. ..... 439/342
7,125,275 B1 * 10/2006 Ju et al. ..... 439/342

* cited by examiner

*Primary Examiner*—Khiem Nguyen
(74) *Attorney, Agent, or Firm*—Troxell Law Office, PLLC

(57) ABSTRACT

This invention is about providing a kind of electrical connection design comprising insulator body and conductive terminal; the insulator body is designed with several receptor holes, where each receptor hole is designed with the first conductive terminal and the second conductive terminal; the outer side of the two conductive terminals are designed with conductive connecting section, the inner side is designed with elastic structure. As the first conductive terminal moves downward under pressure, the elastic structure generates elastic deformation. When not under pressure, the elastic structure will move the first conductive terminal upward due to the elasticity, returning to the original state. In addition, the said electrical structure is designed with a shifting structure. As the two conductive terminals are moving relative to each other, at least one conductive terminal will generate shifting along level direction, enabling the scratching action between the conductive terminal and the corresponding electronic component, thus realizing the better electrical connectivity between electronic component and PCB.

10 Claims, 5 Drawing Sheets

ELECTRICAL CONNECTOR

BACKGROUND OF THE INVENTION (a) Field of the Invention

This invention is about the design of a kind of electrical connector, in particular a kind of electrical connector used for the press on contact of a chip module.

(b) Description of the Prior Art

Presently there is a kind of LGA type chip module available in some electronic products (such as computer). The conductive connection of this kind of chip module is in the form of a washer. The electrical connector connecting to it is designed with the press on contact terminal in contact with the conductive connection. The electrical connector of present art comprises insulator body and conductive terminal; the insulator body is installed with a terminal receiving receptor for receiving conductive terminal. The conductive terminal is formed in one body, including the holding section fitted to the main body. The holding section extends downward is installed with the soldering section that is soldered to the PCB; the section extending upward is installed with the contacting section that is pressed on to the chip module. The conductive side of this kind of electrical connector when installing the chip module is pressed on and directly in contact with the conductive connecting terminal of the chip module. Usually a layer of oxidation film is formed between the contacting portion and the conductive connecting side. The oxidation film will obstruct the current and signal transmission speed between conductive terminal and chip module and affect the normal electrical connection. Also, the shape of this kind of terminal is quite complicated, taking a lot of space, and could easily cause higher inductive effect with neighboring terminal and is not in favor of the transmission of high frequency signal.

Hence, there is a need to design a kind of improved electrical connector to overcome the above problem.

SUMMARY OF THE INVENTION

The objective of this invention is in providing a kind of innovative electrical connector design. The impedance of the conductive terminal can be reduced so that there is better electrical connection between conductive terminal and PCB.

To achieve the above objective, the electrical connector of this invention comprises insulator body and conductive terminal; the insulator body is installed with several terminal receiving holes, the characteristics of which are in: each receptor hole is installed with the first conductive terminal and the second electrical terminal; the outer ends of the two conductive terminal are installed with conductive connecting section, the inner ends are installed with an elastic structure. When the first conductive terminal is under pressure and move downward, the elastic structure will generate elastic deformation. When it is not under pressure, the elastic structure will push the first conductive terminal upward due to the elasticity and return to original state. In addition, the said electrical connector is installed with a shifting structure. When two conductive terminals are moving with respect to each other, at least one conductive terminal will generate shifting on level direction, causing scratching action between the conductive terminal and the corresponding electronic component.

Comparing to present arts, there is scratching action between conductive terminal of the electrical connector of this invention and the corresponding electronic component, hence reducing the impedance and realizes better electrical connection between electronic component and PCB.

DETAILED DESCRIPTION OF THE PREFERRED EMBODIMENTS

Figure 1:
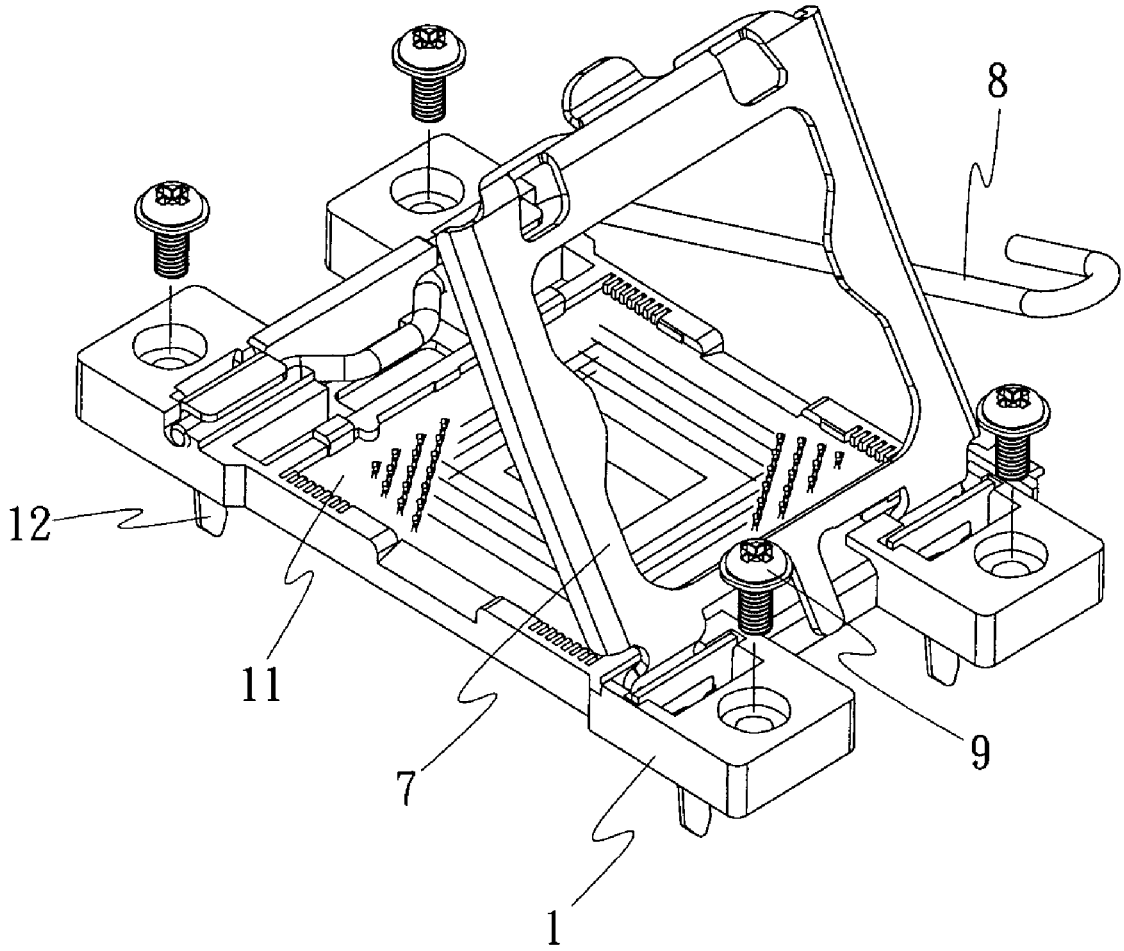
FIG. 1 is the 3D assembly diagram of the electrical connector of this invention.
Figure 2:
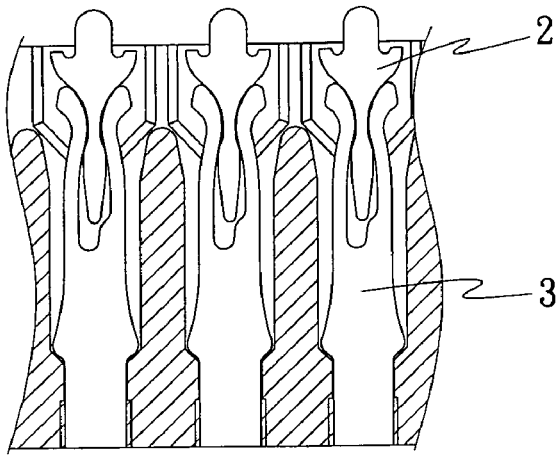
FIG. 2 is the cross-sectional diagram of the electrical connector of this invention.
Figure 3:
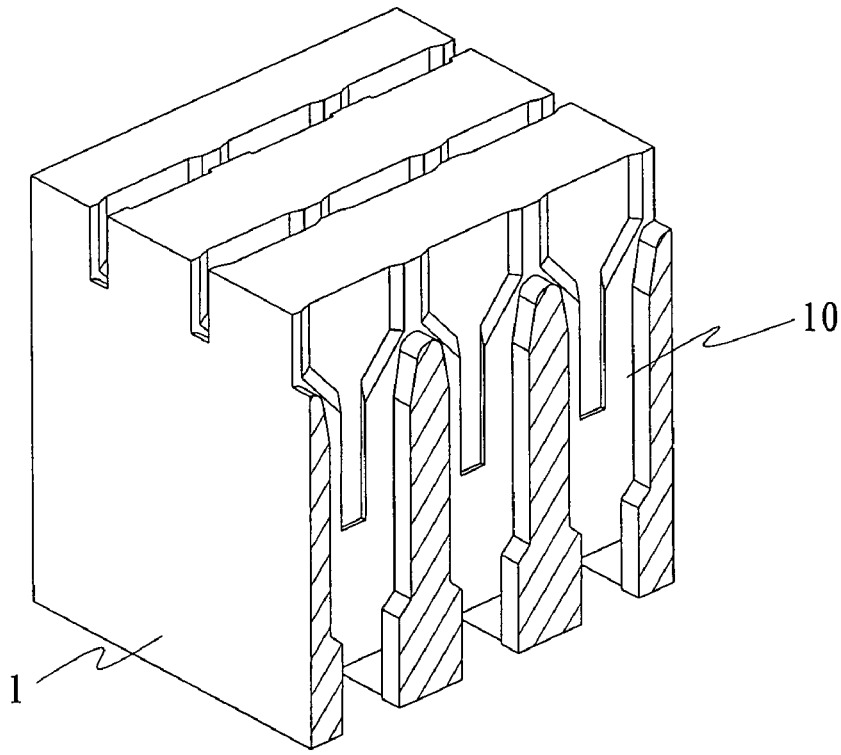
FIG. 3 is the 3D diagram of the insulator body of the electrical connector of this invention.
Figure 4:
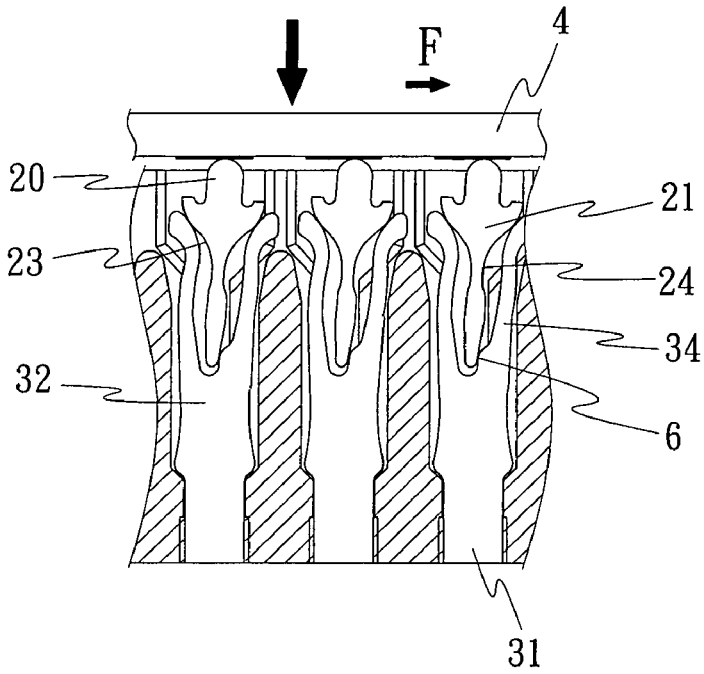
FIG. 4 is the illustration of the electrical connector of this invention when installing chip module.
Figure 5:
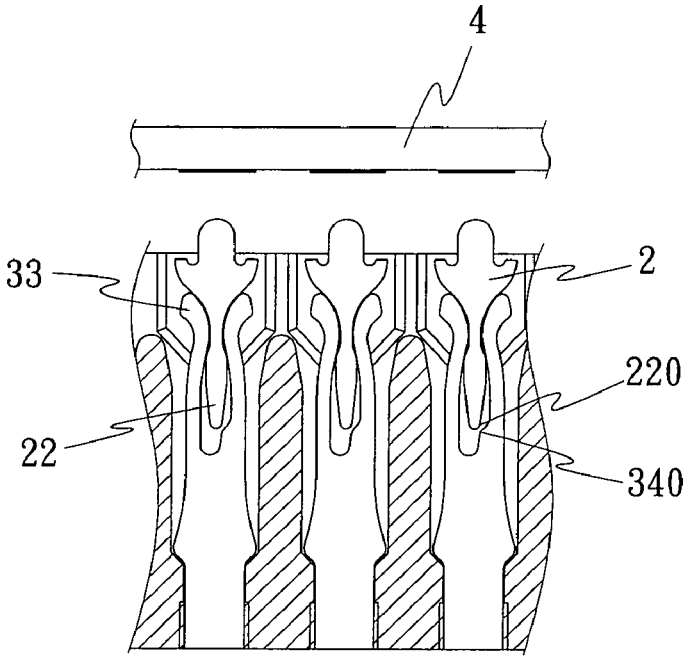
FIG. 5 is the illustration of the electrical connector of this invention before installing chip module.

Please refer to FIGS. 1 to 5. The electrical connector of this invention comprises insulator body 1 and conductive terminal as well as the top cover installed on the insulator body 1, one side of which is the top cover 7 for pressing against the chip module; the other end of the insulator body is installed with a joystick 8 for the pressing of top cover 7 to the insulator body; the four sides of the insulator body is installed with the connecting structure 9 for connecting the electrical connector to the PCB. The insulator body 1 is designed with a depression space 11 that could receive chip module. The lower surface of the insulator body 1 is design with several positioning section 12 for the positioning of the said electrical connector; the receiving space is designed with several terminal receptor holes 10, where each receptor hole 10 is designed with the first conductive terminal 2 for the interconnection with the second conductive terminal 3; the two conductive terminals could move relative to each other; the said second conductive terminal 3 could be fitted into the receptor hole 10; the first conductive terminal 2 could be shifted and connected to the second conductive terminal 3; the said second conductive terminal 3 could be fitted to the receptor hole 10; the first conductive terminal 2 could be moved and connected to the second conductive terminal 3; the said first conductive terminal 2 and the second conductive terminal 3 are all in stamped laminar forms, where the thickness of the first conductive terminal 2 is greater than the thickness of the second conductive terminal 3.

The outer side of the first conductive terminal 2 and the second conductive terminal 3 are designed with the first conductive connecting section 20 and the second conductive connecting section 31; the inner side is designed with a elastic structure; when the first conductive terminal 2 is forced to move downward, the said elastic structure generates deformation; when not forced the elastic structure will push the first conductive terminal 2 upward due to the elasticity and return to the original state. In addition, the two conductive terminals are design with a shifting structure 6. When the two conductive terminals are moving relatively to each other, at least one conductive terminal will cause shifting in level direction, generating scratching effect between the conductive terminal and the corresponding electronic component (chip module in this embodiment, of course it can be other electronic components or also can be the second conductive terminal 3 forced and moved upward, or both conductive terminals moving at the same time). The above elastic structure is the press-on section 21 designed in the first conductive terminal 2 and the elastic section 32 designed in the second conductive terminal 3 for elastically pressing against the above stated press-on section 21, where the two sides of the lower end of the press-on section 21 is designed with sloping surface 23, which faces the second conductive terminal 3 and faces outward; the elastic section 32 of the second conductive terminal 3 comprises two elastic arms 34 in parallel in general; the ends of the two elastic arms 34 could be pressed against sloping surface 23; the top portion of the elastic arm 34 facing the second conductive terminal is designed with stopping section 33; the press-on section of the first conductive terminal 2 facing the second conductive terminal 3 is in extension designed with insertion section 22, and the insertion section 22 is designed with the groove 24 that could match with the depression and protrusion shape in the stopping section, forming the clicked on fitting through the matching of the depression and protrusion shape. The said shifting structure 6 comprises the first sloping surface 220 installed on the outer side of the end of insertion section 22 of the first conductive terminal, and the second sloping surface 340 installed in the bottom of the inner side of the elastic arm 34 of the second conductive terminal. As the chip module 4 is in contact with the first conductive terminal 2, the first conductive terminal moves downward, whose first sloping surface 220 and the second sloping surface 340 of the second conducting terminal match with each other. At this time the first conductive terminal generates shifting in level direction (along F direction) and generate scratching action with chip module 4, removing the oxidation film between the conductive terminal and chip module, and realizing the better electrical connectivity for the chip module and PCB. Of course, there could be only one terminal designed with sloping surface for the above said shifting structure. The scratching action can also be achieved in removing the oxidation film generated between conductive terminal and chip module and consequently realizing better electrical connectivity for the chip module and PCB.

Figure 6:
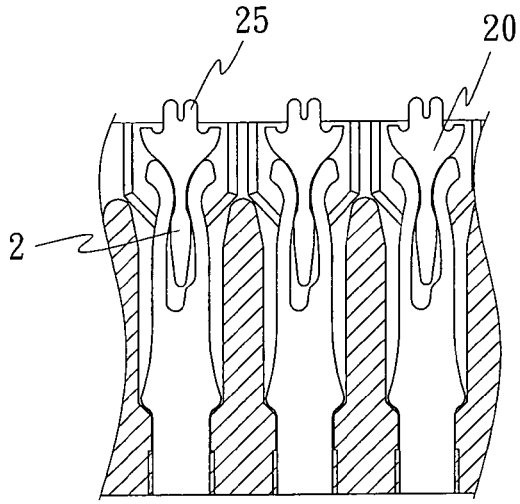
FIG. 6 is the illustration of the second embodiment of the electrical connector of this invention.

FIG. 6 shows the illustration of the second embodiment of this invention. The difference from the above embodiment is in that there is a depression 25 designed in conductive connection section 20 of the said first conductive terminal 2. Both sides of the depression form the two-point contact with the chip module. Similarly, better electrical connectivity could be achieved for the realization of chip module and PCB.

Figure 7:
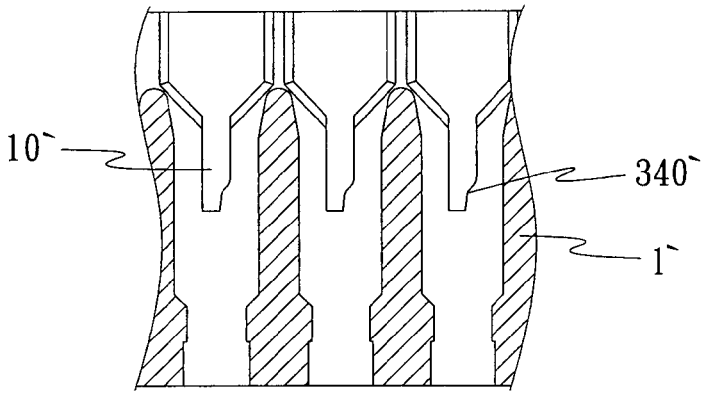
FIG. 7 is the illustration of the third embodiment of the electrical connector of this invention.
Figure 8:
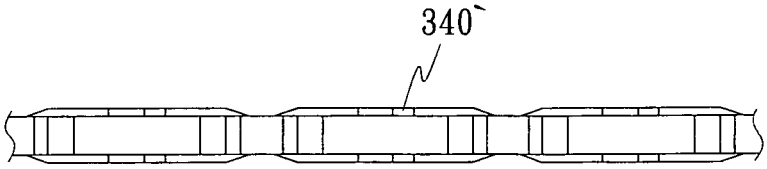
FIG. 8 is the top view of the third embodiment of the electrical connector of this invention.

Please refer to FIGS. 7 and 8, where the third embodiment of this invention is shown. The difference from the first embodiment is in that the stated second sloping surface 340' is not designed inside the second conductive terminal but installed within the terminal receptor hole 10' of the insulator body 1'. The design of this kind of structure can similarly remove the oxidation film between conductive terminal and chip module, therein realizing better electrical connectivity for the chip module and PCB.

Figure 9:
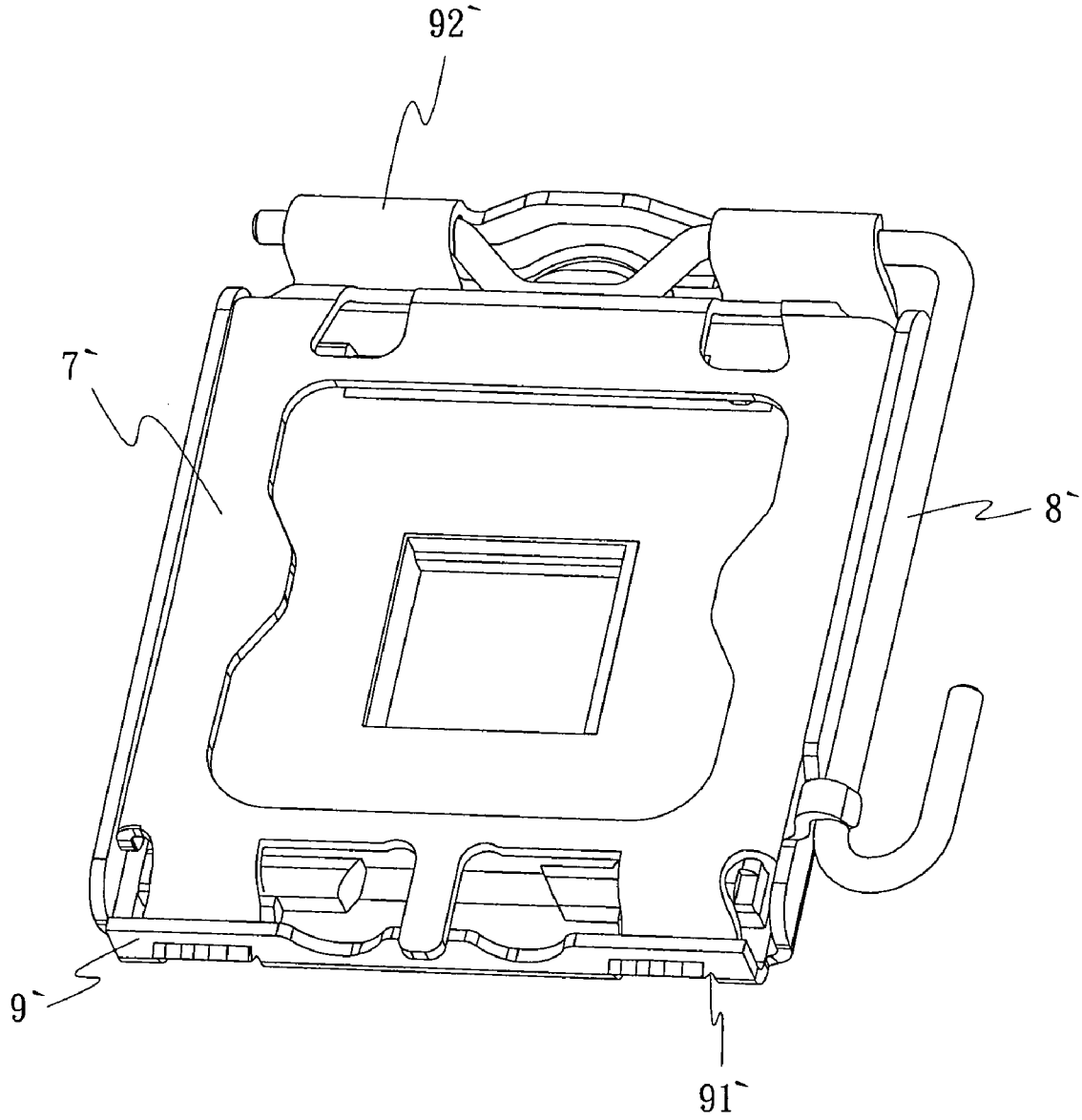
FIG. 9 is the illustration of the fourth embodiment of the electrical connector of this invention.

Please refer to FIG. 9, where the illustration of the fourth embodiment of the electrical connector is shown. The difference between this embodiment and the first embodiment is in: the top cover 7' of the said electrical connector of this embodiment is not connected to the insulator body. There is another metal base 9' installed in the said electrical connector; the insulator body 1 is fixed onto the metal base 9', one side of the insulator 9' is designed with a centrally connecting hole 91' that is centrally connected to the top cover 7; the other side is installed with the central connecting section 92' of the centrally connected joystick 8', of which in the implementation process could also achieve the result of above said embodiment.

What is claimed is:

1. An electrical connector comprising: an insulator body and a conductive terminal; the insulator body is designed with several terminal receptor holes, each receptor hole is designed with a first conductive terminal and a second conductive terminal; outer sides of both conductive terminals are designed with conductive connecting sections; inner sides of both conductive terminals are designed with elastic structure, when the first conductive terminal is forced and moving downward, deformation is generated in the elastic structure; when not under the pressure, the elastic structure returns to original state because of the first conductive terminal pushes upward, the electrical connector is designed with shifting structure, when the first and the second conductive terminals move relative to each other, at least one conductive terminal will generate shifting in the level direction, enabling the scratching action between conductive terminals and the corresponding electronic component.

2. The electrical connector according to claim 1, wherein the elastic structure is the press-on section designed in the first conductive terminal, and the elastic section designed in the second conductive terminal for elastically fitting the above said press-on structure, and at least one conductive terminal is designed with a sloping surface.

3. The electrical connector in claim 2, wherein the sloping surfaces designed in the two sides of the lower side of the press-on section, facing the second conductive terminal and facing outward, the elastic section of the second conductive terminal includes two elastic arms in parallel in general, the ends of the two elastic arms are pressed against the sloping surface.

4. The electrical connector in claim 3, wherein the top of the said elastic arm is designed with the stopping section, the press-on section of the first conductive terminal facing the second conductive terminal is in extension designed with an insertion section, and the insertion section is designed with a groove matching with the press-on section.

5. The electrical connector in claim 1, wherein the shifting structure includes at least the sloping surface of a conductive terminal, when two conductive terminals are moving relatively to each other, the other conductive terminal will move along sloping surface, enabling at least one conductive terminal to generate shifting direction.

6. The electrical connector in claim 5, wherein the two conductive terminals are both designed with corresponding sloping surfaces.

7. The electrical connector in claim 1, wherein the two conductive terminals are both in stamped lamination form.

8. The electrical connector in claim 1, wherein the thickness of the first electrical terminal is greater than the second electrical terminal.

9. The electrical connector in claim 1, wherein the conductive connecting section of the first conductive terminal is designed with depression, the two ends of the depression forms contacting points.

10. The electrical connector in claim 1, wherein a click-on fixing structure is formed between the two conductive terminals.

* * * * *